US005675999A

United States Patent [19]

Carlstrom

[11] Patent Number: 5,675,999

[45] Date of Patent: Oct. 14, 1997

[54] SNOWBOARD LOCK

[76] Inventor: Glenn Levi Carlstrom, 1120 Mount Carmel Rd., Parkton, Md. 21120

[21] Appl. No.: 587,498

[22] Filed: Jan. 17, 1996

[51] Int. Cl.[6] ..... E05B 73/00

[52] U.S. Cl. ..... 70/18; 70/19; 70/58; 211/4

[58] Field of Search ..... 70/18, 58, 14, 70/19, 57, 59–62; 211/4

[56] References Cited

U.S. PATENT DOCUMENTS

| | | | |
|---|---|---|---|
| 2,133,883 | 10/1938 | Aubert . | |
| 3,242,704 | 3/1966 | Barreca | 70/58 |
| 3,275,160 | 9/1966 | Zürker . | |
| 3,643,810 | 2/1972 | Highberger | 70/58 X |
| 3,753,359 | 8/1973 | Frey | 70/19 |
| 3,754,420 | 8/1973 | Oellerich | 70/58 |
| 3,959,995 | 6/1976 | Fletcher | 70/18 |
| 3,985,275 | 10/1976 | Allen | 70/58 X |
| 3,990,655 | 11/1976 | Covell | 70/58 X |
| 3,999,409 | 12/1976 | Bell | 70/58 |
| 4,216,665 | 8/1980 | McKeluey | 70/58 |
| 4,267,715 | 5/1981 | Aylesworth | 70/58 |
| 4,326,747 | 4/1982 | Finnegan | 294/147 |
| 4,598,561 | 7/1986 | Girard | 70/58 |
| 4,896,519 | 1/1990 | Pitts | 70/58 |
| 5,119,980 | 6/1992 | Grim et al. | 70/18 X |
| 5,177,986 | 1/1993 | Jensen | 70/18 |
| 5,265,449 | 11/1993 | Rashleigh | 70/18 |

FOREIGN PATENT DOCUMENTS

| | | | |
|---|---|---|---|
| 2700796 | 7/1978 | Germany | 70/58 |

*Primary Examiner*—Loyd A. Gall
*Attorney, Agent, or Firm*—Leonard Bloom

[57] ABSTRACT

A locking device for securely engaging a snowboard between the bindings allowing it to be locked to a stationary object. The locking device comprises of two bars that encompass the snowboard being hinged at one end and lockable at the other end. The locking device is secured to a stationary object by a locking cable that can be looped around a stationary object and then locking its ends together.

5 Claims, 3 Drawing Sheets

SNOWBOARD LOCK

BACKGROUND OF THE INVENTION

This invention relates to a portable locking device for securing a snowboard to a stationary object.

Snowboarding is a relatively new and very fast growing winter sport. Along with its increased popularity came an increase in snowboard theft. Snowboards are required by most ski and snowboarding resorts to be left outside of the lodge while using the restroom or getting refreshments. Currently, there are no suitable devices available for securing a snowboard to a stationary object. There are similar restraining devices for skis; for example, see U.S. Pat. Nos. 2,133,883; 3,275,160; 3,753,359; 3,754,420; 3,999,409; 4,598,561; 4,326,747. All of the references above were specifically designed for skis because snowboards did not exist when they were designed. They will not work with snowboards because of the size difference between skis and snowboards. Skis are approximately 2 to 3 inches wide and 1 inch thick whereas a snowboard is 10 to 12 inches wide and only about 0.25 inch thick. A second problem with using the above devices on snowboards is that they were all designed to clamp two skis together and some secure poles also but with a snowboard there is only one object and no poles.

It would therefore be advantageous to provide a portable snowboard locking device capable of noninjuriously securing a snowboard to a stationary object.

SUMMARY OF THE INVENTION

Accordingly, several objects and advantages of my invention are its lightweight durable construction, portability, and securing capability. It is designed to lock one object, that being a snowboard, rather than multiple objects of previous art. It will be large enough to completely encompass a snowboard, which previous devices could not do. It will enable a snowboard to be secured by clamping and encircling the snowboard at it's center point between it's two bindings. The two bindings, one on each side of the invention, will disable it from being slid off either end of the snowboard. Once the invention is clamped onto the snowboard it will then secure the snowboard to a stationary object by means of a locking cable.

The objects and advantages of my invention are:

(a) to provide a means for securing a snowboard;

(b) to provide a snowboard locking device which is relatively lightweight for portability;

(c) to provide a snowboard locking device which is durable in cold weather;

(d) to provide a snowboard locking device which secures the snowboard without alteration of the snowboard;

(e) to provide a snowboard locking device that will not cause damage to the snowboard;

(f) to provide a snowboard locking device that is of durable construction and will discourage theft;

(g) to provide a snowboard locking device that can be manufactured quickly and cost effectively.

Further objects and advantages of my invention will become apparent from a consideration of the drawings and ensuing description.

DETAILED DESCRIPTION OF THE PREFERRED EMBODIMENT

The invention is best understood by reference to the Figures wherein like parts are designated with like numbers throughout all Figures.

Snowboards have two bindings for coupling the rider's feet to the board. These bindings are attached to the middle section of the snowboard; the center of the board being between the bindings. A close fitting snowboard lock 30 placed between the bindings or at the center of the snowboard engages the snowboard at its strongest point. Snowboard is held firmly with snowboard lock 30 due to its durability and clamping ability. It is impossible to slide snowboard lock 30 off the snowboard because the bindings one located at each side of snowboard lock 30 are of suitable height to prevent snowboard lock 30 from sliding past them. It is therefore impossible to remove a snowboard from snowboard lock 30 without damaging the snowboard, snowboard lock 30, or both.

Figure 1:
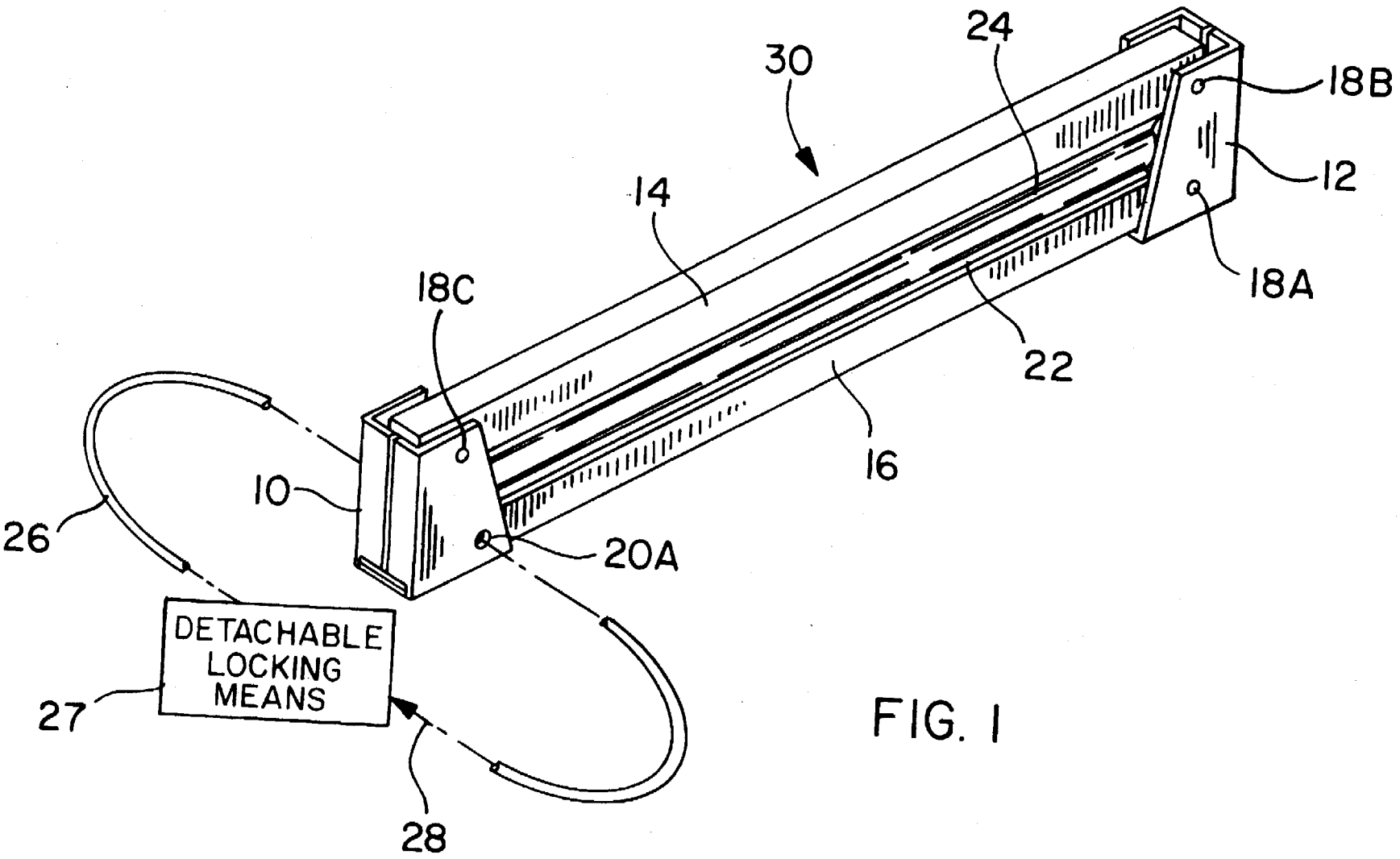
FIG. 1 is a perspective view of the snowboard lock shown in closed position.
Figure 2:
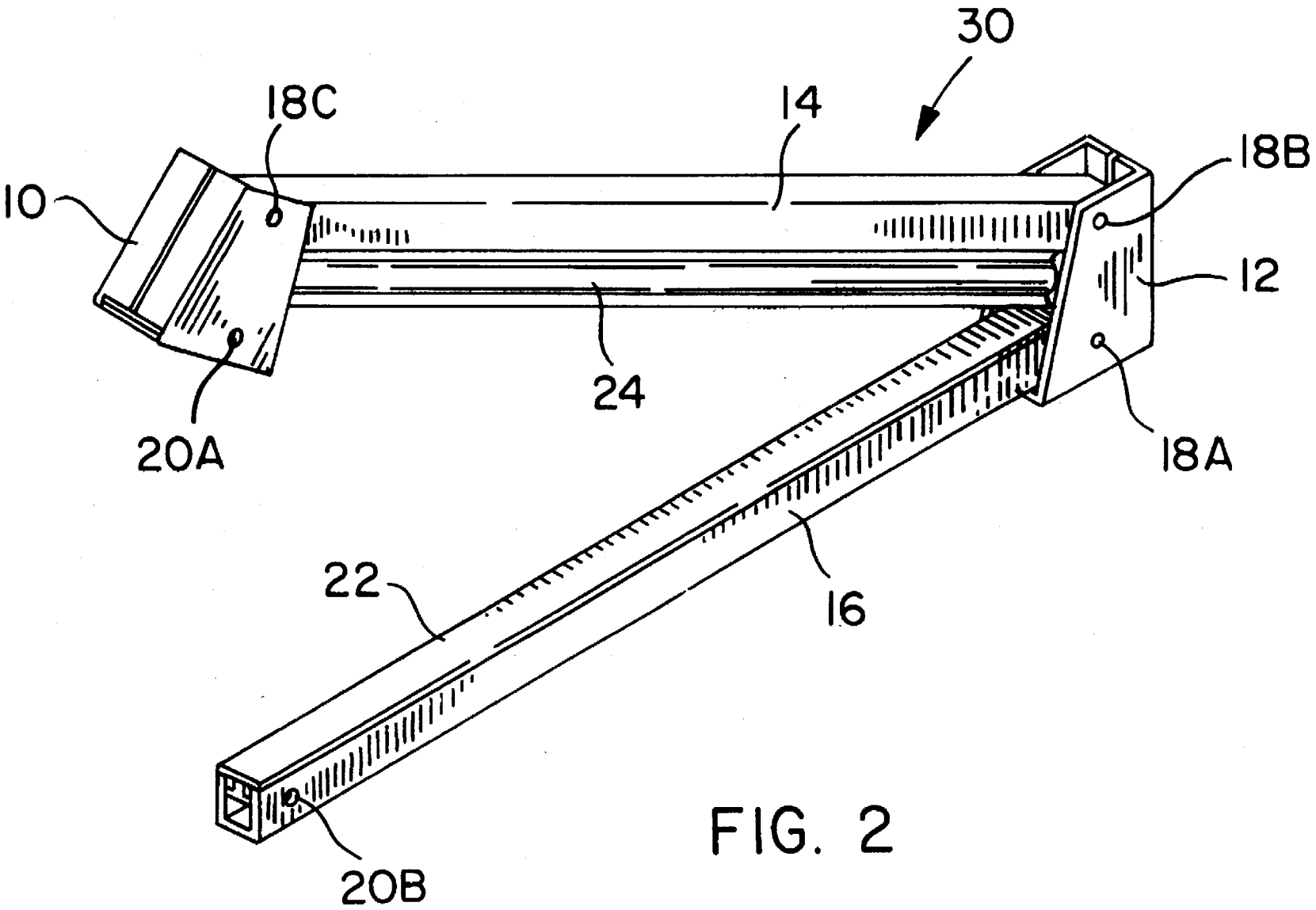
FIG. 2 is a perspective view of the body of the snowboard lock shown in open position.

As shown in FIG. 1 and 2, snowboard lock 30 consists of two rigid bars, top bar 14 and bottom bar 16 connected at each end by left end 10 and right end 12 to snugly encompass a snowboard at its approximate center. Top bar 14 and bottom bar 16 are of suitable length so that the width of a snowboard will fit inside snowboard lock 30. In its closed position, snowboard lock 30 secures a snowboard by placing a locking cable or other suitable device through holes 20*a*–20*b* and locking it to a stationary object.

In detail, snowboard lock 30 consists of bottom bar 16 which is firmly connected to right end 12 by fastener 18*a*. Fastener 18*a* passes through one side of right end 12 then through end of bottom bar 16 and then through the other side of right end 12. Fastener 18*a* is flared at both ends to hold it in place. Bottom bar 16 is of suitable length so that the width of a snowboard will fit between left end 10 and right end 12. The right end of bottom bar 16 is placed inside of right end 12 so that bottom bar 16 is tight against the inside of right end 12 and the bottom and sides of bottom bar 16 fit snugly against the inside of right end 12. Bottom bar 16 could also be secured to right end 12 by any other suitable means such as, crimping, welding, or the like.

Right end 12 is then connected to top bar 14 by fastener 18*b*. Fastener 18*b* passes through one side of right end 12 then through top bar 14 and then through the other side of right end 12. In this connection, fastener 18*b* connects top bar 14 securely to right end 12 while allowing top bar 14 to pivot vertically on fastener 18*b* which is flared at both ends to hold it in place. The sides of top bar 14 touch the inside of right end 12 while being loose enough that top bar 14 can slide inside of right end 12 when it is pivoting. Top bar 14 is slightly shorter than bottom bar 16 allowing enough space between the right end of top bar 14 and right end 12 so that top bar 14 does not hit or rub right end 12 when pivoting.

The left end of top bar 14 is connected to left end 10 by fastener 18*c*. Fastener 18*c* passes through one side of left end 10 then through top bar 14 and then through the other side of left end 10. In this connection, fastener 18*c* connects top bar 14 to left end 10 while allowing it to pivot vertically on fastener 18*c* which is flared at both ends to hold it in place. The sides of top bar 14 touch the inside of left end 10 while being loose enough that top bar 14 can slide inside of left end 10 when it is pivoting. Top bar 14 is slightly shorter than bottom bar 16 allowing enough space between the left end of top bar 14 and left end 10 so that top bar 14 does not hit or rub on left end 10 when pivoting.

When in closed position bottom bar 16 fits snugly inside of left end 10 and the end of bottom bar 16 is tight against the inside of left end 10. At this point hole 20*a* in left end 10 aligns with hole 20*b* in bottom bar 16 allowing cable 26 to pass through both left end 10 and bottom bar 16. Hole 20*a* goes through both sides of left end 10 and hole 20*b* goes through both sides of bottom bar 16. Shown in FIG. 1 by phantom lines a loop 26 of flexible cable may be passed through aligned holes 20*a*–20*b* and that locking means 27 may detachably secure the ends of loop 26 to each other, for key-operated release or for multi-digit combination-lock release. The arrowhead 28 shown at juncture of one end of cable 26 to locking means 27 will represent the cable end fitting which is releasably locked in its engagement with means 27. Cable end 28 is of diametric size as to be insertable through aligned holes 20*a*–20*b*. With cable 26 through aligned holes 20*a*–20*b* snowboard lock 30 may be secured to a stationary object.

Figure 3:
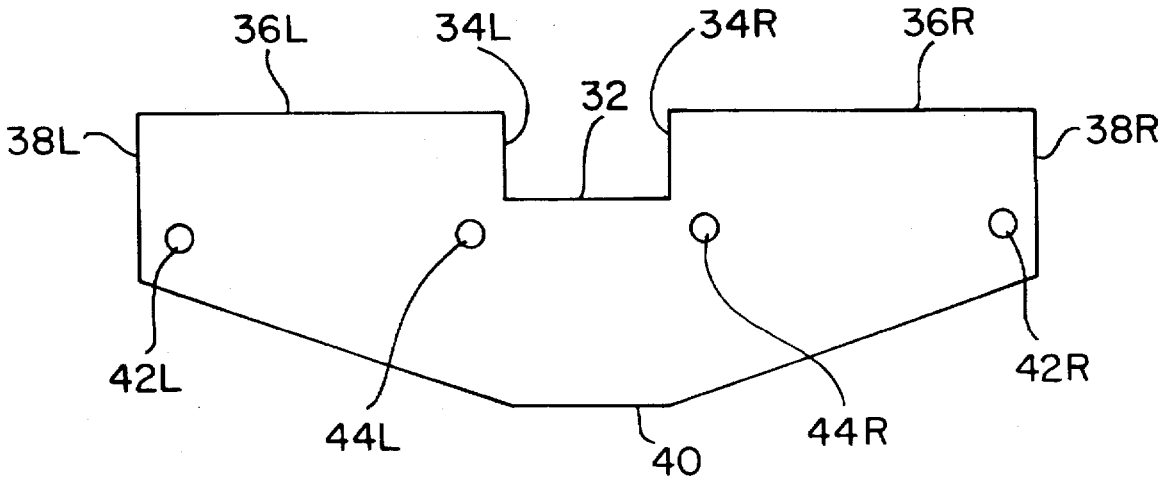
FIG. 3 is a view showing how the end pieces of the snowboard lock are made.

FIG. 3 shows how left end 10 and right end 12 are made from a single sheet of metal. Being formed from a single sheet of metal gives them maximum stability. Both ends are made to be exactly the same, except for the lock cable hole is slightly larger than the holes for the fasteners. To make the end pieces, two pieces of sheet metal need to be cut to the shape shown in FIG. 3. The following bends are all made upward at a right angle. Now the end pieces come into shape by bending the metal from right end of edge 32 to edge 38R parallel to edge 36R and from the left end of edge 32 to edge 38L parallel to edge 36L. Bends are also made from edge 34L to edge 40 parallel to edge 38L and from edge 34R to edge 40 parallel to edge 38R. Finally, holes of appropriate size are drilled at locations 42R–42L–44R–44L as shown in FIG. 3. Left end 10 and right end 12 may also be made in any suitable fashion or shape that will provide the same results as the above description.

In FIG. 1 and 2, left end 10, right end 12, top bar 14 and bottom bar 16 are constructed from a suitable gauge aluminum to provide maximum durability and rust resistance. However, left end 10, right end 12, top bar 14 and bottom bar 16 may be made from any suitable material as for example, a suitable metal, plastic, composite or the like. Fasteners 18*a*–18*b*–18*c* are metal pins which are flared at the ends to hold them in place. Fasteners 18*a*–18*b*–18*c* may also be any suitable means for connecting the two parts involved as for example, rivet, screw, bolt, wire or the like.

The portion of top bar 14 and portion of bottom bar 16 which touch the snowboard are lined to protect the snowboard. Top protector 24 is attached to the inside of top bar 14 which faces bottom bar 16 to protect the top of the snowboard and gives a tight secure fit of snowboard lock 30 on a snowboard. Bottom protector 22 is attached to the inside of bottom bar which faces top bar 14 to protect the bottom of the snowboard. Bottom protector 22 is made from a plastic and top protector 24 is made out of soft rubber. Both bottom protector 22 and top protector 24 may also be made from any suitable material as for example, rubber, plastic, composite or the like.

Figure 4:
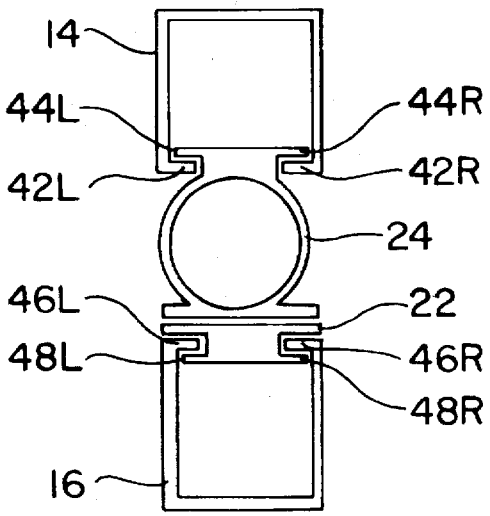
FIG. 4 is a end view of the snowboard lock.

FIG. 4 shows how top bar 14 and bottom bar 16 are slotted so that top protector 24 and bottom protector 22 can be slid into them during construction. Top protector 24 is held to top bar 14 by top ridges 42R–42L on top bar 14 by interlocking with top tabs 44R–44L on top protector 24. Likewise, bottom protector 22 is held to bottom bar 16 by bottom ridges 46R–46L on bottom bar 16 by interlocking with bottom tabs 48R–48L on bottom protector 22. Top protector 24 and bottom protector 22 could be affixed to top bar 14 and bottom bar 16 respectively by other suitable means as for example, glue, tape, rivet, bolt, screw or other suitable means. If top protector 24 and bottom protector 22 are affixed by another method than the method previously described it may not be necessary for top bar 14 and bottom bar 16 be slotted.

To operate snowboard lock 30 it must first be put in open position as shown in FIG. 2. Slide snowboard lock 30 over a snowboard from its open or left end so that the bottom of the snowboard faces bottom protector 22. While holding snowboard lock 30 in this position it is closed by pushing the open ends of top bar 14 and bottom bar 16 together. Next left end 10 is pivoted around and so that it catches the left end of bottom bar 16 inside of it and aligns holes 20*a*–20*b*. Now snowboard lock 30 is firmly grasping a snowboard and can be secured by placing a locking cable through holes 20*a*–20*b*, looping it around a stationary object and then locking it.

It will be seen that the described invention amply meets all stated objects and provides maximum security for snowboards. It offers this level of security while being a durable, lightweight, reliable, yet economical device.

While the above description contains many specifications, these should not be construed as limitations of the scope of the invention, but rather as an exemplification of one preferred embodiment thereof. Many other variations are possible. For example, the snowboard lock could have other shapes such as oval, circular, etc.; the end which is fastened to both bars could be replaced by a hinge which connects two otherwise unconnected halves, etc.; the end which the cable goes through could be replaced by an eye-bolt, u-bolt, hasp or like mechanism being fixed to one bar and having a slot in the opposite bar. Accordingly, the scope of the invention should be determined not by the embodiments illustrated, but by the appended claims and their legal equivalents.

What is claimed is:

1. A portable snowboard locking device for securing a snowboard, comprising:

an upper bar and a lower bar, the bars being substantially straight, each bar having a length, a first end and an opposite second end, a first end piece pivotally connected to the first end of the upper bar, the first end piece being fixedly connected to the first end of the lower bar, a second end piece pivotally connected to the second end of the upper bar, the second end piece being pivotally movable to engage the second end of the lower bar and retain the second end of the upper bar adjacent to the second end of the lower bar, a removably elongated flexible means to secure the second end piece to the second end of the lower bar, and a compressible strip attached to one of the bars, the compressible strip having a length approximately equal to the length of the bars such that when the device is secured the compressible strip is adapted to be compressed against the snowboard and prevents movement of the snowboard from between the upper bar and the lower bar.

2. The locking device of claim 1, further comprising:

an opening formed in the second end piece and an opening formed in the second end of the lower bar, securing means removably disposed in the opening in the second end piece and in the opening in the second end of the lower bar to secure the bars in a closed position.

3. The locking device of claim 1, wherein a width of the snowboard is receivable in the length of the locking device between the first and second end pieces.

4. The locking device of claim 1, wherein the elongated flexible means has a locking means thereon.

5. The locking device of claim 1, wherein the bars are approximately of equal length.

* * * * *